US009913051B2

(12) United States Patent
Pilgrim et al.

(10) Patent No.: US 9,913,051 B2
(45) Date of Patent: Mar. 6, 2018

(54) HEARING APPARATUS WITH A FACILITY FOR REDUCING A MICROPHONE NOISE AND METHOD FOR REDUCING MICROPHONE NOISE

(71) Applicant: SIVANTOS PTE. LTD., Singapore (SG)

(72) Inventors: Thomas Pilgrim, Erlangen (DE); Henning Puder, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 218 days.

(21) Appl. No.: 13/682,962

(22) Filed: Nov. 21, 2012

(65) Prior Publication Data

US 2014/0140555 A1 May 22, 2014

(30) Foreign Application Priority Data

Nov. 21, 2011 (DE) ..... 10 2011 086 728

(51) Int. Cl.
*H04R 25/00* (2006.01)

(52) U.S. Cl.
CPC ..... *H04R 25/453* (2013.01); *H04R 25/407* (2013.01)

(58) Field of Classification Search
CPC . H04R 1/04; H04R 25/00; H04R 1/22; H04R 2410/03
See application file for complete search history.

(56) References Cited

U.S. PATENT DOCUMENTS 4,185,168 A 1/1980 Graupe
5,610,991 A * 3/1997 Janse ..... G10L 21/0208 381/13
6,178,249 B1 * 1/2001 Hietanen ..... H04R 19/005 367/181
6,230,123 B1 * 5/2001 Mekuria ..... H03G 3/32 704/226
6,351,731 B1 2/2002 Anderson et al.
7,106,866 B2 * 9/2006 Astorino ..... F01N 1/065 381/71.11

(Continued)

FOREIGN PATENT DOCUMENTS

DE 10016620 A1 12/2001
DE 102008055760 A1 5/2010

(Continued)

OTHER PUBLICATIONS

Hua OU, "The impact of bilateral gain reduction on localization and speech perception in spatially-separated noise", Iowa Research Online, University of Iowa, 2010, US.

(Continued)

*Primary Examiner* — Duc Nguyen
*Assistant Examiner* — Taunya McCarty
(74) *Attorney, Agent, or Firm* — Laurence A. Greenberg; Werner H. Stemer; Ralph E. Locher

(57) ABSTRACT

An input signal is provided with a low microphone noise in a hearing apparatus. The microphone noise in the input signal of the hearing apparatus is reduced, by the input signal being filtered by a Wiener filter, if a noise power determined at the input signal is smaller than a predetermined limit value. The Wiener filter is however deactivated, if the noise power is greater than the limit value or equal to the limit value.

13 Claims, 9 Drawing Sheets

(56) References Cited

U.S. PATENT DOCUMENTS

| | | | | |
|---|---|---|---|---|
| 2001/0038699 | A1* | 11/2001 | Hou | 381/92 |
| 2002/0164013 | A1* | 11/2002 | Carter et al. | 379/387.02 |
| 2003/0147538 | A1 | 8/2003 | Elko | |
| 2004/0190730 | A1* | 9/2004 | Rui et al. | 381/92 |
| 2004/0213419 | A1 | 10/2004 | Varma et al. | |
| 2006/0074646 | A1 | 4/2006 | Alves et al. | |
| 2006/0202751 | A1* | 9/2006 | Stephelbauer et al. | 330/51 |
| 2007/0260454 | A1* | 11/2007 | Gemello et al. | 704/226 |
| 2008/0065380 | A1* | 3/2008 | Kwak | G10L 17/04 704/243 |
| 2008/0159554 | A1* | 7/2008 | Sung et al. | 381/71.6 |
| 2008/0159573 | A1 | 7/2008 | Dressler et al. | |
| 2008/0194953 | A1* | 8/2008 | Kerber | 600/437 |
| 2008/0292107 | A1* | 11/2008 | Bizjak | 381/56 |
| 2008/0292122 | A1 | 11/2008 | Nordahn et al. | |
| 2009/0299742 | A1 | 12/2009 | Toman et al. | |
| 2009/0316916 | A1* | 12/2009 | Haila et al. | 381/57 |
| 2010/0036659 | A1 | 2/2010 | Haulick et al. | |
| 2010/0046776 | A1 | 2/2010 | Fischer et al. | |
| 2010/0239104 | A1 | 9/2010 | Iser et al. | |
| 2010/0239105 | A1* | 9/2010 | Pan | G10K 11/1782 381/94.9 |
| 2010/0278365 | A1 | 11/2010 | Biundo Lotito et al. | |
| 2010/0329492 | A1* | 12/2010 | Derleth et al. | 381/317 |
| 2011/0103626 | A1* | 5/2011 | Bisgaard et al. | 381/313 |
| 2011/0110536 | A1* | 5/2011 | Hovesten et al. | 381/111 |
| 2011/0249844 | A1 | 10/2011 | Merks et al. | |
| 2011/0299695 | A1* | 12/2011 | Nicholson | G10K 11/1782 381/71.6 |
| 2012/0084080 | A1* | 4/2012 | Konchitsky | G10L 21/0208 704/210 |
| 2013/0182876 | A1 | 7/2013 | Mülder et al. | |

FOREIGN PATENT DOCUMENTS

| | | | |
|---|---|---|---|
| EP | 0483701 | A2 | 5/1992 |
| EP | 1919257 | A2 | 5/2008 |
| EP | 2151821 | A1 | 2/2010 |
| EP | 2230664 | A1 | 9/2010 |
| GB | 2057228 | A | 3/1981 |
| GB | 2126851 | A | 3/1984 |
| WO | 9635314 | A1 | 11/1996 |
| WO | 9847315 | A1 | 10/1998 |
| WO | 2006036490 | A1 | 4/2006 |
| WO | 2007099116 | A2 | 9/2007 |
| WO | 2010133703 | A2 | 11/2010 |

OTHER PUBLICATIONS

Schlüter, A, "Perzeptive Beurteilung von Sprache im Störgeräuch", Carl von Ossietzky Universität Oldenburg, Dec. 21, 2007, Chapter 2 Background—English abstract.

Martin, R, "Noise Power Spectral Density Estimation Based on Optimal Smoothing and Minimum Statistics", IEEE Transactions on Speech and Audio Processing, vol. 9, No. 5, Jul. 2001, pp. 504-512.

Willems/Blank/Mohn, "Electro-Fachkunde 3 Nachrichtentechnik" Springer Fachmedien Wiesbaden GmbH, 1988, pp. 411-412, ISBN 978-3-519-16807-2—English translation pp. 411-412.

* cited by examiner

HEARING APPARATUS WITH A FACILITY FOR REDUCING A MICROPHONE NOISE AND METHOD FOR REDUCING MICROPHONE NOISE

CROSS-REFERENCE TO RELATED APPLICATION

This application claims the priority, under 35 U.S.C. § 119, of German application DE 10 2011 086 728.7, filed Nov. 21, 2011; the prior application is herewith incorporated by reference in its entirety.

BACKGROUND OF THE INVENTION

Field of the Invention

The invention relates to a hearing apparatus, in which at least one microphone is coupled to a facility for reducing microphone noise. The invention also includes a method for reducing microphone noise in an input signal of a hearing apparatus. The term "hearing apparatus" is understood here to mean in particular a hearing device. The term also however includes other wearable or non-wearable acoustic devices such as headsets, headphones and the like.

Hearing devices are wearable hearing apparatuses which are used to provide hearing assistance to the hard-of-hearing. In order to accommodate the numerous individual requirements, various designs of hearing devices are available such as behind-the-ear (BTE) hearing devices, hearing device with external earpiece (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. With these devices the damaged hearing is stimulated either mechanically or electrically.

The key components of hearing devices are principally an input transducer, an amplifier and an output transducer. The input transducer is normally a sound transducer e.g. a microphone and/or an electromagnetic receiver, e.g. an induction coil. The output transducer is most frequently realized as an electroacoustic transducer, e.g. a miniature loudspeaker, or as an electromechanical transducer, e.g. a bone conduction receiver. The amplifier is usually integrated into a signal processing unit. This basic configuration is illustrated in FIG. 1 using the example of a behind-the-ear hearing device. One or more microphones 2 for picking up ambient sound are incorporated into a hearing device housing 1 to be worn behind the ear. A signal processing unit 3 which is also integrated into the hearing device housing 1 processes and amplifies the microphone signals. The output signal from the signal processing unit 3 is transmitted to a loudspeaker or receiver 4, which outputs an acoustic signal. The sound may be transmitted to the device wearer's eardrum by way of an acoustic tube which is fixed in the auditory canal by an ear-mold. Power for the hearing device and in particular for the signal processing unit 3 is supplied by a battery 5 which is also integrated in the hearing device housing 1.

The microphones 2 may be condenser microphones. The disadvantage with this type of microphone is that condenser microphones produce residual noise. The microphone noise always overlays the sound signal acquired by the condenser microphone and can, in a quiet environment, be perceived by a user of the hearing device, by way the earpiece 4, as an unwanted artifact. If a hearing loss is balanced out by the hearing device by frequency-selective amplification of an input signal, the probability that the microphone noise for the amplified frequencies is raised in the level above the hearing threshold of the hearing device user is particularly high, so that the user also always hears an unwanted noise even in a quiet environment. The microphone noise has a generally characteristic frequency response, which is similar to that of pink noise.

In order to prevent a user from perceiving the microphone noise in a quiet environment, attempts are made to always suppress the microphone noise in the input signal of the hearing apparatus if the microphone noise is not overlayed by a signal of an ambient sound and is herewith masked or covered. For this purpose it is known to attenuate the input signal of a hearing apparatus as a function of a level of the input signal by a compressor, the characteristic curve of which effects an attenuation of the input signal for input signals with a small level, such as typically arise for microphone noise alone. For input signals which clearly exceed a specific minimum level, the characteristic curve of the compressor conversely contains an increase of one, i.e. microphone signals with a large input level are not influenced by the compressor. The characteristic curve of the processor can be adjusted to a type of microphone, but is however generally fixedly predetermined.

A change in temperature or ageing of the microphone may result in the power spectral density of the microphone noise changing such that, in at least some frequency channels of the compressor, the level of the microphone noise lies in the range of the transition of the characteristic curve from the compressing to the neutral range with the amplification of one. This results in relative level fluctuations in the microphone noise being amplified by the amplification factor of the compressor in the output signal of the compressor then acting in a level dependent manner on the input signal. The noise is therefore particularly clearly perceivable for a user of the hearing device. A temperature dependency of the power spectral density of the microphone noise and a dependency on an age of the microphone cannot be compensated for by a compressor without complicated additional measures.

SUMMARY OF THE INVENTION

It is accordingly an object of the invention to provide a hearing apparatus with a facility for reducing a microphone noise and a method for reducing a microphone noise which overcome the above-mentioned disadvantages of the prior art methods and devices of this general type.

With the foregoing and other objects in view there is provided, in accordance with the invention a method for reducing microphone noise in an input signal of a hearing apparatus. The method includes filtering the input signal via a Wiener filter if a noise power determined for the input signal is smaller than a predetermined limit value; and deactivating the Wiener filter if the noise power is greater than the predetermined limit value or equal to the predetermined limit value.

With the inventive method, a microphone noise contained in the input signal is reduced, by the input signal being filtered by a Wiener filter, if noise power determined at the input signal is smaller than a predetermined limit value. On the other hand, if the noise power is greater than the limit value or equal to the limit value, the Wiener filter is deactivated.

Accordingly, provision is made with the inventive hearing apparatus to couple a microphone to a facility for reducing a microphone noise. This facility includes a Wiener filter and an estimation facility coupled hereto and configured to determine an estimated value for a noise power. In this process the Wiener filter is able to apply an attenuation, the value of which is determined on the basis of the estimated value for the noise power, to an input signal received by the facility, e.g. a microphone signal. The input signal filtered in this way then forms an output signal of the facility for the further processing in the hearing apparatus.

With the inventive hearing apparatus, the facility for reducing a microphone noise is also set up to monitor the estimated value for the noise power and to deactivate the Wiener filter if the estimated value is greater than a predetermined limit value. Deactivation of the Wiener filter is understood to mean in conjunction with the invention that its influence on the input signal is completely reduced or at least reduced to a degree which is insignificant for further processing.

The inventive method and the inventive apparatus are advantageous in that the microphone noise, in a quiet environment, if the noise power contained in the input signal lies below the limit value, can be very flexibly suppressed by the Wiener filter. On account of the time-dependent determination of the noise power, the Wiener filter is able to follow temperature or ageing-specific changes in the power spectral density of the microphone noise and thus continuously adjust the attenuation to the current course of the power spectral density. By deactivating the Wiener filter if a noise level which exceeds the limit value is identified, this also effectively prevents microphone signals not generated by the microphone itself, but instead by an ambient sound, from being unintentionally changed by the facility for reducing the microphone noise.

In order to be able to deactivate the Wiener filter here in a noise power-dependent manner, one embodiment of the inventive method provides for weighting an attenuation of the Wiener filter acting on the input signal, the so-called "gain", with a weighting factor, which is a function of the determined noise power. This is herewith advantageous in that a Wiener filter structure known from the prior art can be used, the attenuation or gain of which then acts or does not act on the input signal of the hearing apparatus as a function of the noise power.

The amplification of the fluctuation in the microphone noise described in conjunction with the compressor, in the event that its power lies close to the limit value, can be very easily prevented in one embodiment in the inventive method, in which the attenuation of the Wiener filter is undertaken in a gradual transition so that a transition occurs between a completely active attenuation and a completely deactivated attenuation. A transition according to a ramp function and a tangens hyperbolicus function have proven particularly suitable here.

Furthermore, it has proven expedient to limit the determined noise power to a predetermined highest value. The estimation facility for determining the noise power is then also able particularly quickly to determine a current value for the noise power if the Wiener filter was deactivated for a period of time and is then activated again in a quiet environment. By limiting the noise power to the highest value, a period of time, which the estimation facility requires to converge with the actual value of the noise power, is herewith significantly reduced.

The noise power is expediently estimated for a signal part of the input signal, in other words for at least one channel of a filter bank for instance, by which the input signal is analyzed spectrally, on the basis of this signal part itself. A statistical estimation method can be used to estimate the noise power, such as is known from the prior art in numerous variants for the estimation of noise powers.

Since the microphone noise is an interference signal inherent to the microphone, which is generated independently of the ambient noise, a characteristic microphone noise curve can also be used to determine the noise power for at least one signal part of the input signal. This is herewith advantageous in that no uncertain estimation of the noise power is required in this signal part. The characteristic curve can be determined for instance when producing the hearing apparatus or the microphone.

According to a further embodiment of the inventive method, provision is made to also define the already described limit value for the activation or deactivation on the basis of a characteristic curve of a microphone. This makes it possible to accurately determine, for the different microphone types and for individual frequency bands, the noise level for which the Wiener filter is to be activated or deactivated.

The use of a Wiener filter to attenuate the microphone noise has the further advantage that a processed microphone noise can be generated on its basis, which has no interfering fluctuations, such as the known musical noise phenomenon. To this end, the inventive method can easily be further developed in that with an active Wiener filter, an attenuation of the Wiener filter acting on the input signal is limited to a predetermined maximum attenuation value.

The inventive method can also particularly advantageously combine with a beam-former, in which a directional effect can be set with the aid of a directional parameter. This may be any type of adaptive beam-former, as are available in the prior art. In order to combine the beam forming with the inventive method, the individual microphone signals of the microphone of the beam-former do not necessarily have to be processed individually. Instead, in the inventive method, the input signal for the facility for reducing the microphone noise is formed from the plurality of microphone signals of the microphone by the beam-former, i.e. only the (individual) output signal of the beam-former has to be processed. In order to adjust the inventive method here to the signal properties of the output signal of the beam-former, it is sufficient, when determining the noise power, to initially scale the input signal, in other words the beam-former output signal, as a function of a current value of the directional parameter of the beam-former. Sudden changes to the noise power density of the microphone noise contained in the input signal, such as are typically caused by the beam-former when setting new values for the directional parameters, are herewith advantageously effectively compensated. A standard estimation facility can therefore be used once again to estimate the noise power.

In order to use the thus determined noise power also to calculate the attenuation of the Wiener filter, one development of the method provides to back-scale the determined noise power in dependence on the current value of the directional parameter. The estimated value for the noise power herewith follows the sudden change in the microphone noise in the input signal.

In addition, provision is made in accordance with another development to also limit the attenuation of the Wiener filter acting on the input signal to a highest value, as a function of the current value of the directional parameter. This enables an almost flat power density distribution of the processed microphone noise to be achieved, in other words a residual white noise which is significantly less bothersome to a user.

In conjunction with the noise power-dependent deactivation of the Wiener filter, provision is made in accordance with another embodiment of the inventive method to also set the limit value for the deactivation in dependence on a current value of the directional parameter. This is herewith advantageous in that the microphone noise is then also suppressed by the Wiener filter, if on account of an unfavorable setting of the beam-former, it is attenuated to such a degree that it would otherwise exceed the limit value.

The hearing apparatus pertaining to the invention contains developments, which include features, which were already described in conjunction with the developments of the inventive method. A development of the inventive hearing apparatus therefore provides that a plurality of microphones is coupled to the facility in order to estimate the noise power via a beam-former, which is configured so as to generate an input signal for the facility from the microphone signals of the microphone. With the beam-former, as already described, a directional effect can be set with the aid of at least one directional parameter. The estimation facility for the noise power is herewith configured in the described manner so as to scale the input signal formed from the microphone signals in dependence on a value of the directional parameter of the beam-former in order to determine the estimated value for the noise power.

Since the features of the remaining developments of the inventive hearing apparatuses similarly result from the developments of the inventive method, they are not explained again in more detail here.

Other features which are considered as characteristic for the invention are set forth in the appended claims.

Although the invention is illustrated and described herein as embodied in a hearing apparatus with a facility for reducing a microphone noise and a method for reducing a microphone noise, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The examples represent preferred embodiments of the invention.

Figure 1:
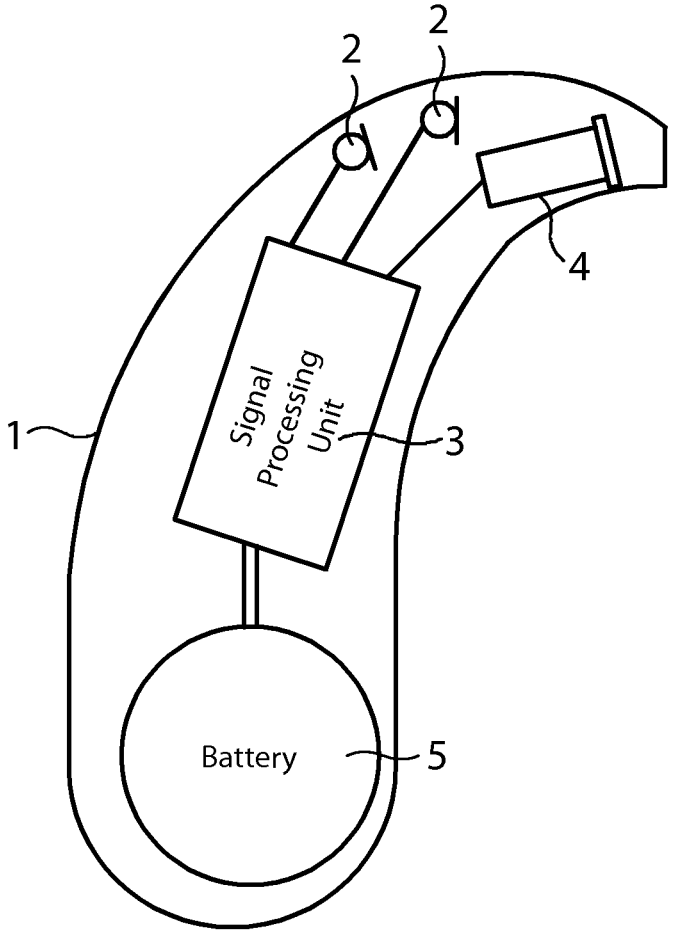
FIG 1 PRIOR ART
FIG. 1 is a diagrammatic representation of a behind-the-ear hearing device according to the prior art.
Figure 2:
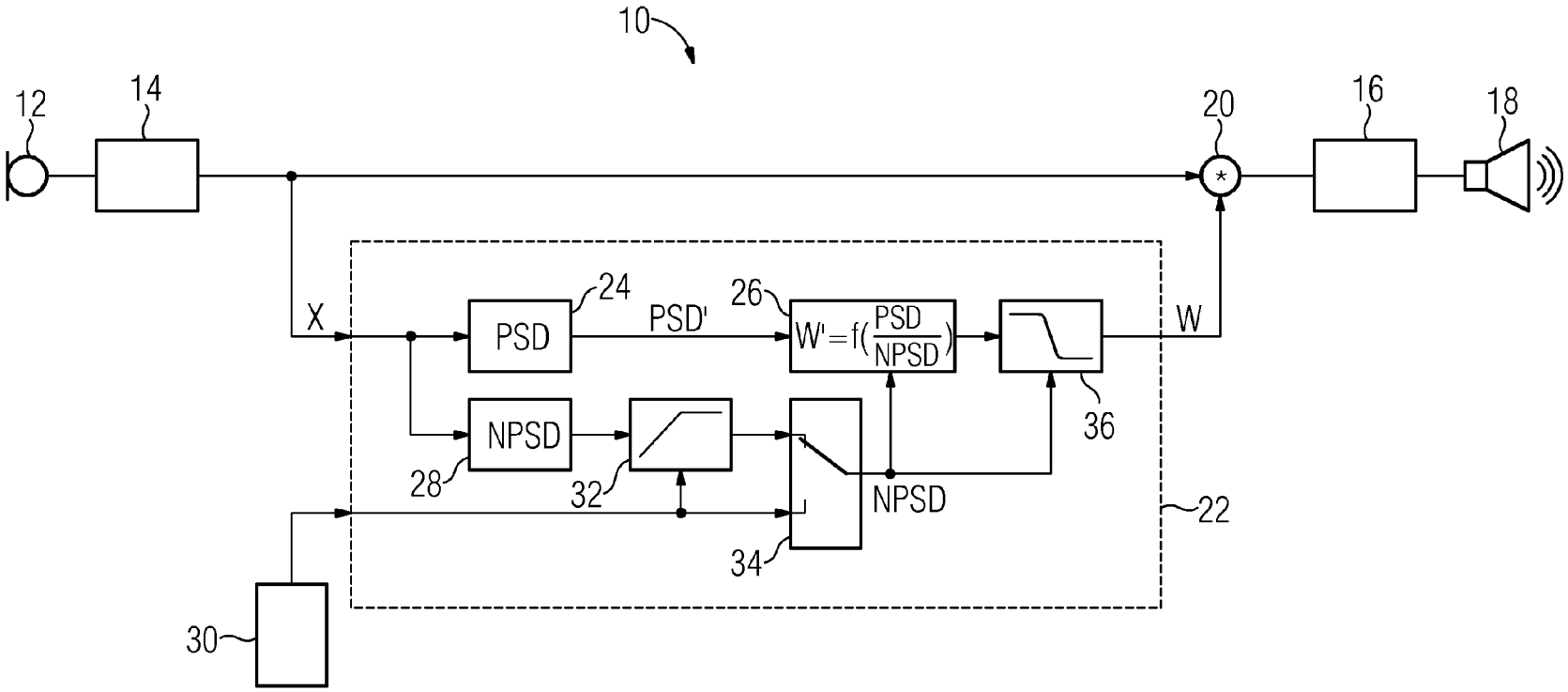
FIG. 2 is a block diagram of a facility for reducing microphone noise, which is disposed in a hearing apparatus according to an embodiment of the inventive hearing apparatus.

FIG. 2 shows a hearing apparatus 10, which is a behind-the-ear hearing device or an in-the-ear hearing device for instance. A microphone 12 acquires an ambient sound and converts the same into an analog electrical signal, which is converted by a preprocessing facility 14 into a digital input signal x by an analog-digital converter. Provision can also be made with the preprocessing facility 14 to divide the signal of the microphone 12 into a plurality of frequency channels by a filter bank. The input signal x then includes a corresponding number of narrow band partial signals. An output signal is generated from the input signal x by a signal processing facility 16, the output signal being converted by a receiver 18 into a sound signal and being emitted to an ear of a user of the hearing apparatus 10.

The microphone 12 may be a condenser microphone for instance. Aside from the wanted signal (a wanted signal and an ambient noise) generated from the ambient sound, the analog input signal always also contains a microphone noise, which is generated by the microphone 12 itself. In an environment in which it is quiet such that in the input signal x, or at least in one of its frequency channels, the microphone noise has a significantly greater signal power than the signal part generated by the ambient sound, it may nevertheless not result in the user of the hearing apparatus 10 perceiving the microphone noise over the receiver 18. The microphone noise is suppressed by an attenuation W, which in the example shown in FIG. 2, acts as a multiplicative, if necessary frequency-dependent attenuation factor W via a multiplier M on the input signal x or its individual frequency channels. The attenuation factor W is set by a facility 22 for suppressing the microphone noise. If the ambient sound generates a part in the input signal x which is sufficiently large to mask the microphone noise, the attenuation factor W for this time segment and if necessary for the corresponding frequency channel is set by the facility 22 to a value of one or almost one. If the ambient sound is conversely quiet such that the microphone noise may be partially audible by way of the receiver 18, the attenuation factor W is set to a value between zero and one for this period of time and if necessary for the corresponding frequency channel of the attenuation factor W, so that a noticeable attenuation results. The microphone noise is then hereby accordingly reduced in the input signal x.

In order to set the attenuation factor W, the facility 22 contains a facility 24 for calculating a power spectral density (PSD) of the input signal x and a Wiener filter 26 for calculating a gain W'. The gain W' is calculated by the Wiener filter 26 from the power spectral density PSD of the input signal x and an estimated value for the noise power spectral density (NPSD) according to a function f. The facility 24 may include for instance a simple squaring device for determining an amplitude square of the input signal x or a squaring device and a subordinate smoothing facility for calculating a temporal average value. Every other facility for calculating a power spectral density can also be used here. The function f for calculating the gain W' can likewise be a calculation rule which is likewise known per se from the prior art for an attenuation of a noise power contained in a signal. The function f produces a gain W' with a value between zero and one, wherein the value aims all the more for one, the greater the ratio shown in FIG. 2 (PSD/NPSD). The function f may also include an estimation of a signal-to-noise ratio (SNR).

The noise power spectral density NPSD is determined by an estimation facility 28 for a noise power contained in the input signal x and from a characteristic curve 30, which describes the typical noise power spectral density of the microphone noise of the microphone 12. The characteristic curve 30 may have been created for instance during the manufacture of the apparatus 10 by measurements. The estimation facility 28 may be a facility which is known per se from the prior art for determining a noise power in a signal.

With the facility 22, a limiter 32, a switch 34 and a masking facility 36 cause the attenuation factor W only to act on the signal parts of the input signal x in which a level is so low that the signal parts are with high probability exclusively or almost exclusively microphone noise from the microphone 12.

As a function of a switch position of the switch 34, either a fixed (frequency-dependent) estimation of the noise power, which was determined on the basis of the characteristic curve 30, or an actual estimation of the noise power from the estimation facility 28, is fed to the Wiener filter 26 and the filtering facility 36. In the event that the estimation facility 28 is used, the estimation of the noise power spectral density NPSD is limited by the limiter 32 to a predetermined highest value. It is assumed for the following explanations that the highest value amounts to 40 dB. With the specification of decibels used here and below, these are decibels for the sound pressure level (SPL). The highest value for the estimation of the noise power can be derived from the characteristic curve 30, wherein an offset of 25 dB for instance can be added to the characteristic curve value.

The combination of the estimation facility 28 and the limiter 32 forms an estimation of the noise power overall, which operates exclusively within the level region of the microphone noise. This causes a value for the gain W' to be calculated by the Wiener filter 26 for the function f, the latter automatically striving for one, if the input signal x has a power spectral density which is significantly greater than the highest value of the limiter 32, in other words in this example is greater than 40 dB. With the direct use of a characteristic curve 30 as an estimation for the noise power, as can be achieved by correspondingly switching the switch 24, this produces an automatic deactivation of the Wiener filter 26.

Figure 3:
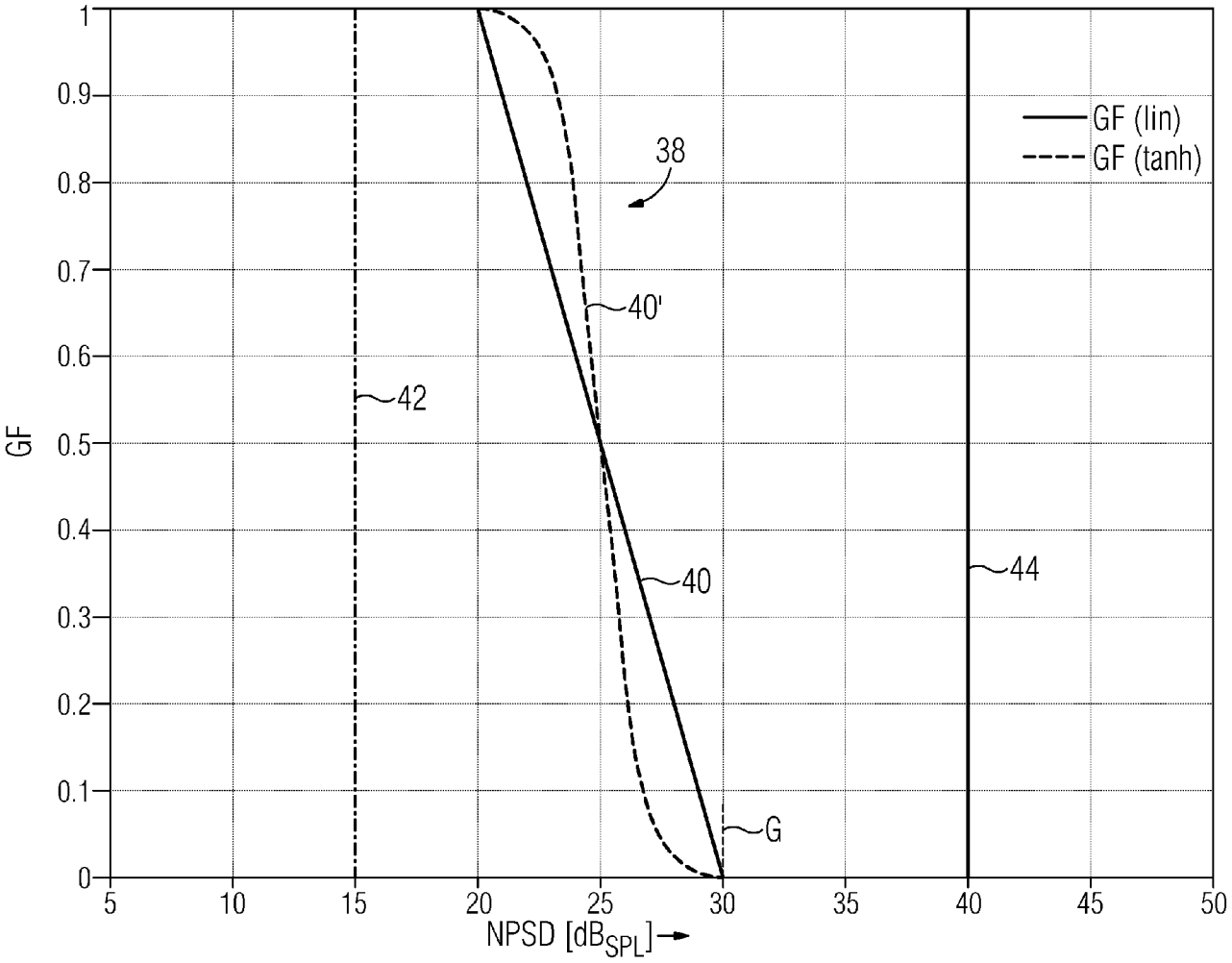
FIG. 3 is a graph showing a characteristic curve, according to which an attenuation of a Wiener filter of the facility in FIG. 2 is weighted.

In order additionally to obtain the audio quality of the sound signal of the receiver 18 in the region of levels of the input signal x close to the limitation effected by the limiter 32, the masking facility 36 also produces a gradual transition. The functionality of the masking facility 36 is explained in more detail below with the aid FIG. 3. A diagram is shown for this purpose in FIG. 3, which shows the dependency of a gain factor GF on a current value for the noise power spectral density NPSD. The extent to which the attenuation factor W is calculated from the gain W' is determined by the masking facility 36 on the basis of the gain factor FG. A gain factor with the value one signifies W=W'. A gain factor with the value zero signifies W=1, i.e. the Wiener filter 26 is deactivated in respect of its influence on the input signal x.

The attenuation factor W is a function of the noise power spectral density NPSD. For a value of the noise power spectral density NPSD<20 dB: W=W' applies. For a noise power spectral density NPSD≥G=30 dB, W=1 applies. A transition 38 is formed there-between by the masking facility 36, which can proceed for instance according to a ramp function 40 or a tangens hyperbolicus function 40'. The value G represents a limit value for the activation or deactivation of the Wiener filter.

In order to illustrate the functionality of the facility 22, the expected noise power 42 determined in the diagram by the characteristic curve 30 and the highest value 44 defined by the limiter 32 are shown. The highest value 44 is expediently set equal to the value G, as shown otherwise here.

On the basis of the measurement of the microphone noise, an overall noise level-dependent limitation of the gain W is implemented by the masking facility 36. The closer the estimation of the noise power spectral density NPSD to the limit value G, the more the attenuation is reduced. This ensures that signal parts which are not dominated by microphone noise remain unattenuated. This prevents the facility 22 from interacting with further signal-processing algorithms in the signal processing facility 16. At the same time, the possibility exists of parameterizing the facility 22 in order to suppress the microphone noise independently of the further algorithms, e.g. by a stronger maximum attenuation effected by the gain W' being exerted on the microphone noise than on a ambient noise by the signal processing facility 16.

Figure 4:
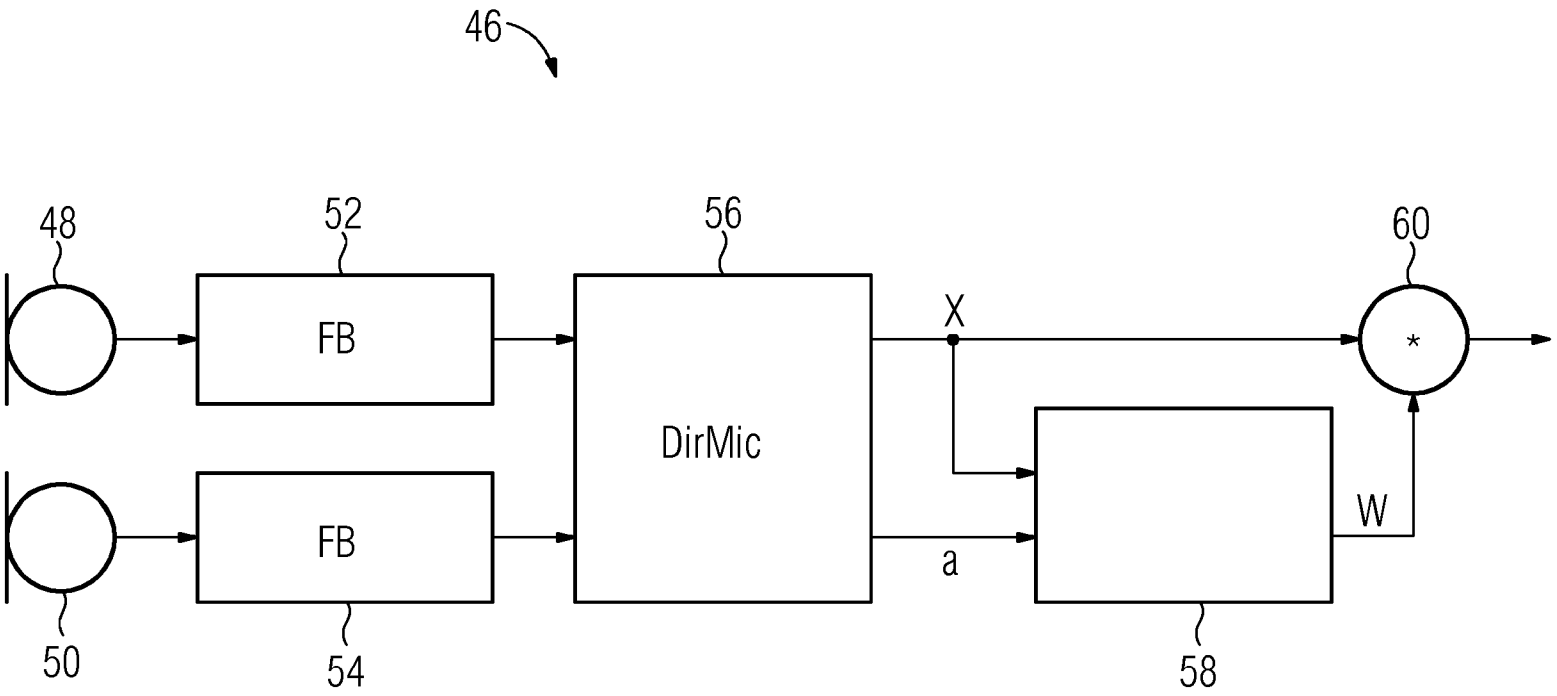
FIG. 4 is a block diagram of the hearing apparatus according to a further embodiment of the inventive hearing apparatus.
Figure 5:
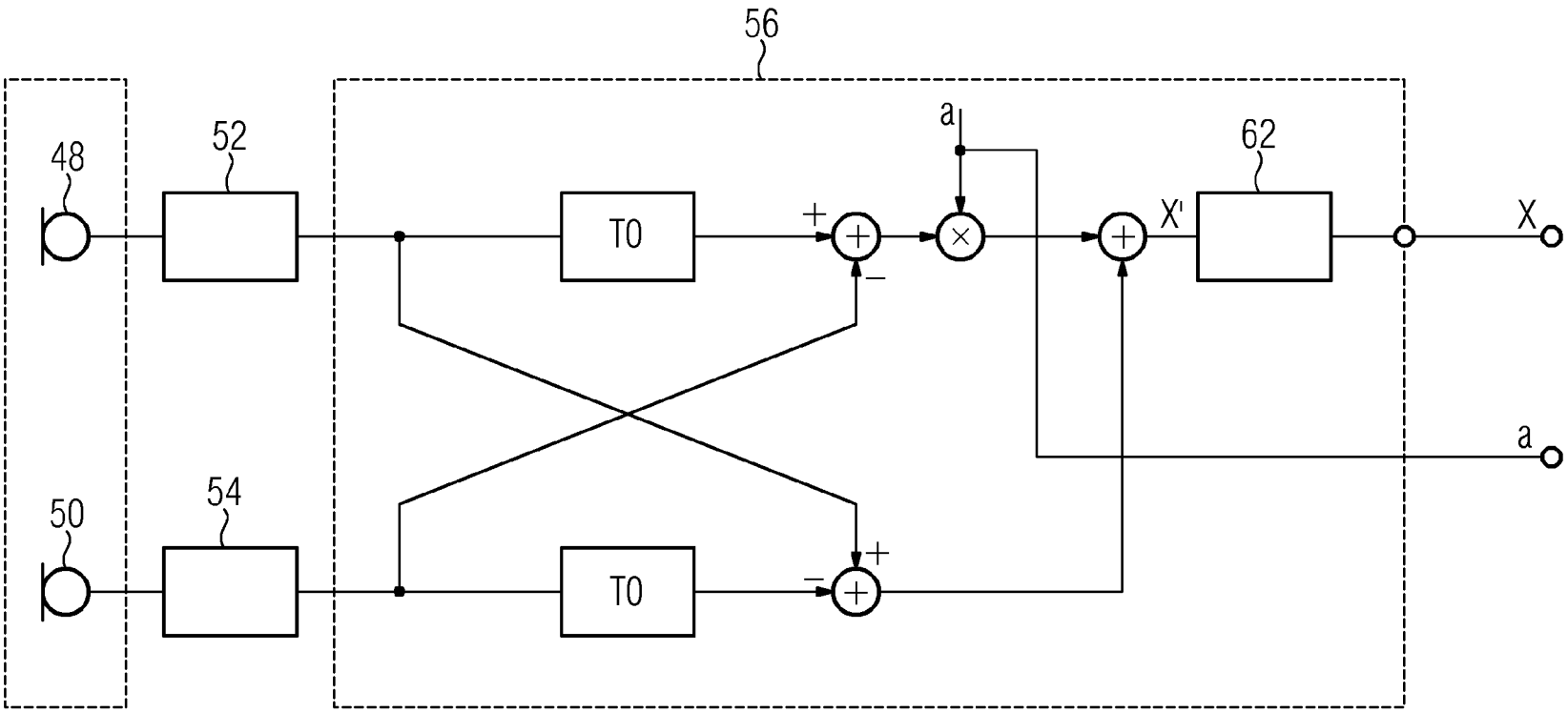
FIG. 5 is a block diagram showing a signal flow of a beam-former, as can be integrated in the hearing apparatus in FIG. 4.

FIG. 4 shows a hearing apparatus 46 with microphones 48, 50, filter banks 52, 54, a beam-former 56, a facility 58 for reducing a microphone noise and a multiplier 60. The digitized microphone signals of the microphone 48 and 50 are combined separately in each instance by the beam-former 56 in individual frequency channels of the filter banks 52, 54 in order to achieve a directional effect. The beam-former 56 may be a beam-former which is known per se from the prior art. By way of example, one possible structure of the beam-former 56 is shown for this purpose in FIG. 5, such as can be provided for processing an individual channel of the filter banks 52, 54. Delay elements with a delay time constant T0 delay the microphone signals of the microphones 48, 50 and are then added to directed signals via an adding device, so that a cardioid signal and an anti-cardioid signal results.

One of the signals is weighted with the value of a directional parameter a by a multiplier, before the two signals are combined to form a directed beam-former signal x' by a further adding device. The described arrangement contains a clearly perceivable high pass characteristic. For this reason, low frequencies are amplified by an amplifier 62, in order to render audible for the user the audio information container therein. This amplification also acts on a microphone noise contained in the directed signal x', which is produced by the two microphones 48, 50. On account of the amplification, the microphone noise also contains a different power density spectral distribution in the input signal x for the hearing apparatus 46, which the amplifier 62 generates, from the original microphone noise of the microphones 48, 50 themselves. In addition, the power spectral density of the microphone noise in the input signal x is changed over time by changing the value of the directional parameter a. With the hearing apparatus 46, these properties of the microphone noise are taken into account in the input signal x when calculating an attenuation W, so that a user of the hearing apparatus 46 does not perceive any interfering microphone noise even with a value of the directional parameter a which changes over time.

The input signal x and the directional parameter a form input values for the facility 58. The facility 58, comparable to the facility 22, calculates an attenuation factor W, which acts on the input signal x of the hearing apparatus 46 by way of the multiplier 60. Similarly to the hearing apparatus 10, the attenuation factor W reduces the microphone noise for the input signal x, without in the process a dominating part produced by an ambient sound similarly being influenced in the input signal x by the attenuation factor W.

Figure 6:
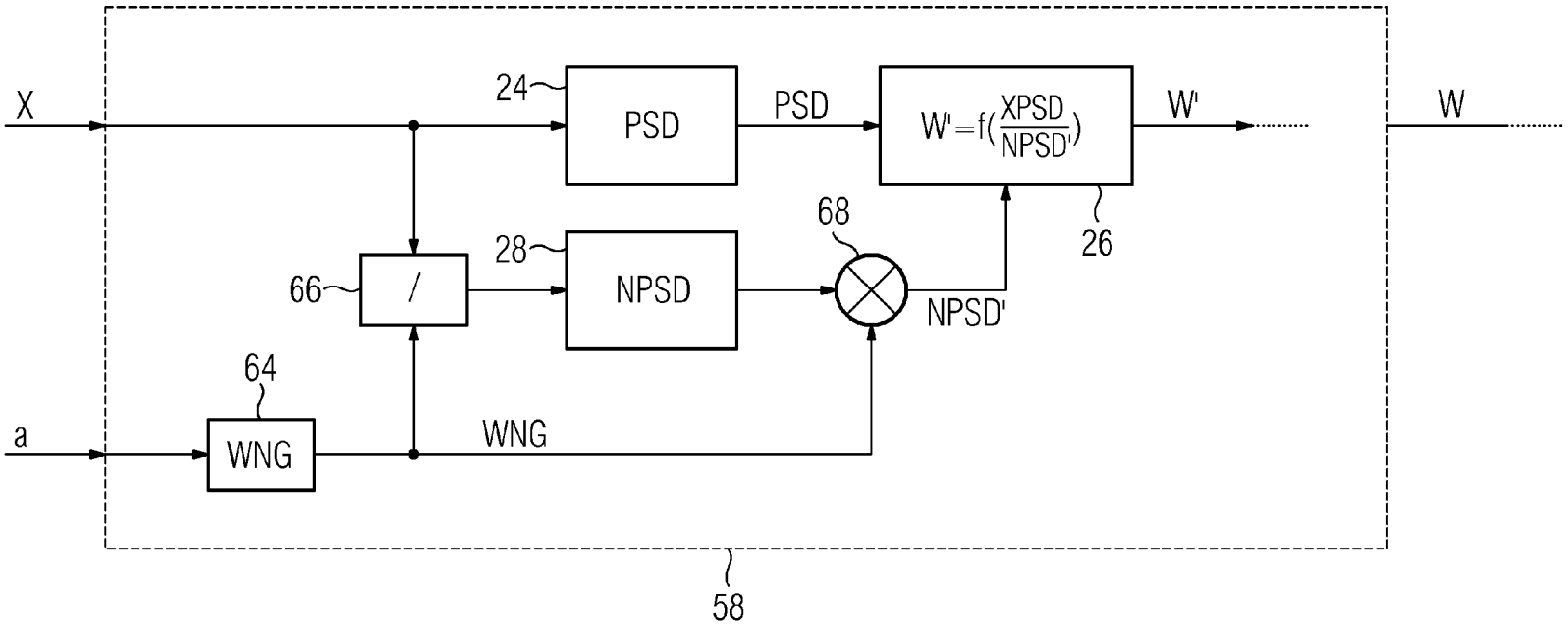
FIG. 6 is a block diagram of the facility for reducing the microphone noise, as can be provided in the hearing apparatus in FIG. 4.

To explain the mode of operation of the facility 58, this is shown again more precisely in FIG. 6. In FIG. 6 components, which correspond to components in terms of their mode of operation, which are shown in FIG. 2, are provided with the same reference characters as in FIG. 2. They are not shown again in conjunction with FIG. 6.

The change in the power spectral density of the microphone noise effected by the value of the directional parameter a in the input signal x is compensated by the change in the power spectral density being calculated by the calculation facility 64 in the form of a White Noise Gain (WNG) and being taken into account by a divider 66 in the form of a scaling of the input signal x. The noise power spectral density NPSD calculated from the scaled input signal x/WNG by the estimation facility 28 is back-scaled by a multiplier 68 and the value for the White Noise Gain WNG to a back-scaled noise power (NPSD'). In conjunction with the beam-former 56 shown in FIG. 5, the following calculation rule is produced as a scaling value WNG for a frequency with a standardized average frequency Ω in the filter banks 52, 54, with which $\Omega=2*\pi*f*Ts$ and Ts is the scanning time of the analog-to-digital converter of the hearing apparatus 46:

$$WNG(\Omega)=[a^2+1+2a*\cos(\Omega*T0/Ts)]/[1-\cos(2*\Omega*T0/Ts)].$$

Figure 7:
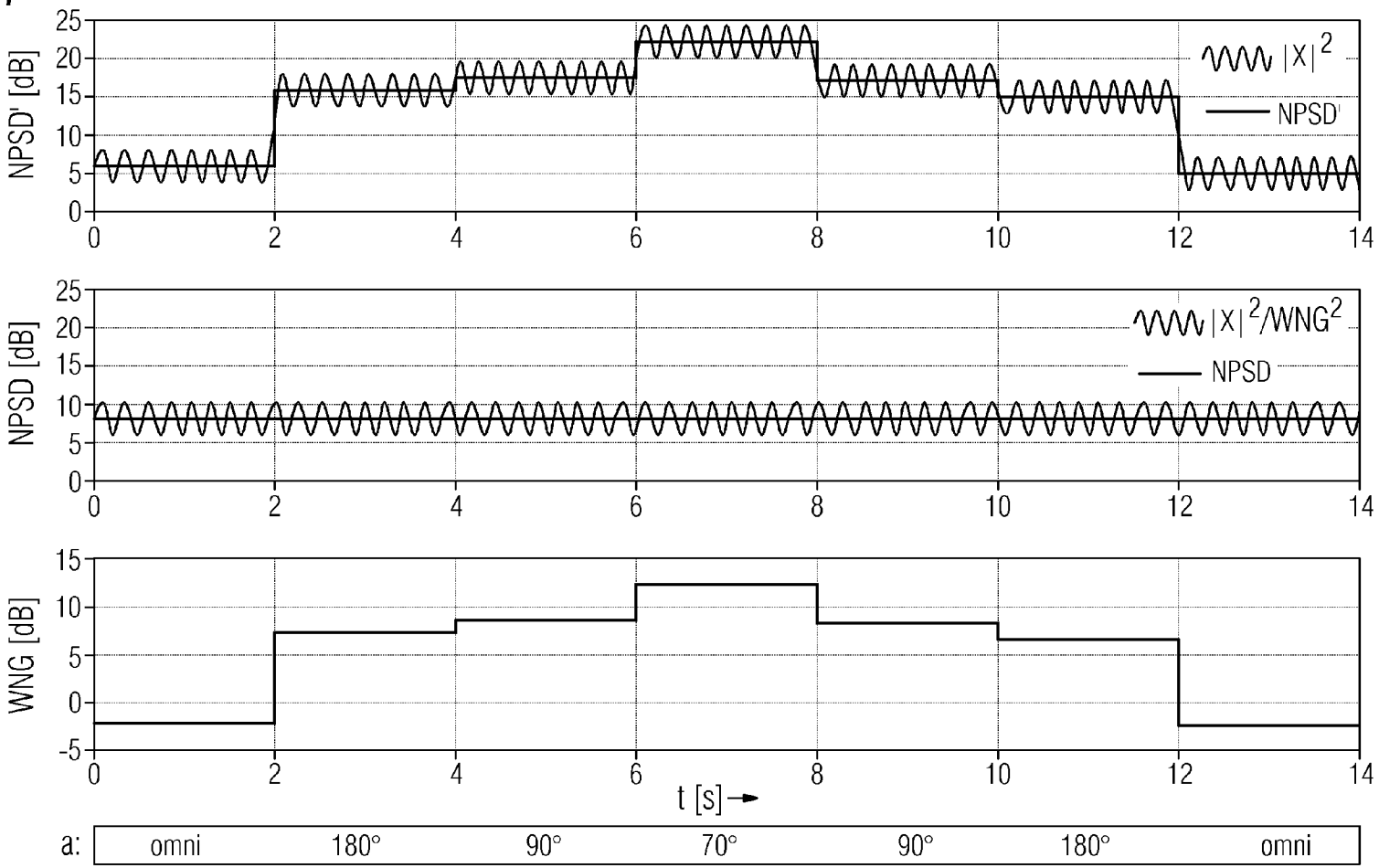
FIG. 7 is a graph showing a temporal curve of an estimated value for a noise power, as may result in a noise power estimation facility of the hearing apparatus in FIG. 4.

With the aid of FIG. 7, the following shows, for an individual frequency component of the input signal x, which estimated values may result for the noise power in the facility 58.

To this end, the lowest diagram in FIG. 7 shows how the value for the directional parameter a is gradually changed with time t during a period of time of 14 seconds, so that an omni-directional directional characteristic of the beam-former 56 results at the start and a notch in the directional characteristic is gradually aligned by a zero steering in different angular directions specified in FIG. 7, in order to then be switched after 12 seconds to an omni-directional directional characteristic. The corresponding value of the White Noise Gain WNG is shown in decibels relating to the corresponding values of the directional parameter a in the graphs above the diagram. For the underlying example in FIG. 7, it should be assumed that the microphone is being operated in a quiet environment, so that the input signal x in the frequency component shown in FIG. 7 exclusively contains the stationary microphone noise. The gradual change in the White Noise Gain (WNG) nevertheless produces a curve of the sum square $|x|^2$ of the input signal x, as is shown in the topmost diagram in FIG. 7. On the basis of this curve, the estimation facility 28 would, on account of its inertia, not be in a position to correctly reproduce the noise power at the transition points (e.g. at second 2). The scaling by the divider 66 produces, as an input signal for the estimation facility 28, a stationary input x/WNG during the curve. The estimation facility 28 calculates a correspondingly correct noise power spectral density NPSD relating to the scaled input signal x/WNG. The back-scaling by the multiplier 68 then produces a correspondingly correct estimation NPSD' for the actual noise power contained in the input signal x. This is used to calculate a gain W' suited to effectively attenuating the microphone noise by the Wiener filter 26.

With the facility 58, the further components explained in conjunction with FIG. 2 can be provided to deactivate the Wiener filter 26 by limiter, a switch and a masking facility. These components are not shown again for the sake of clarity in FIG. 6.

Figure 8:
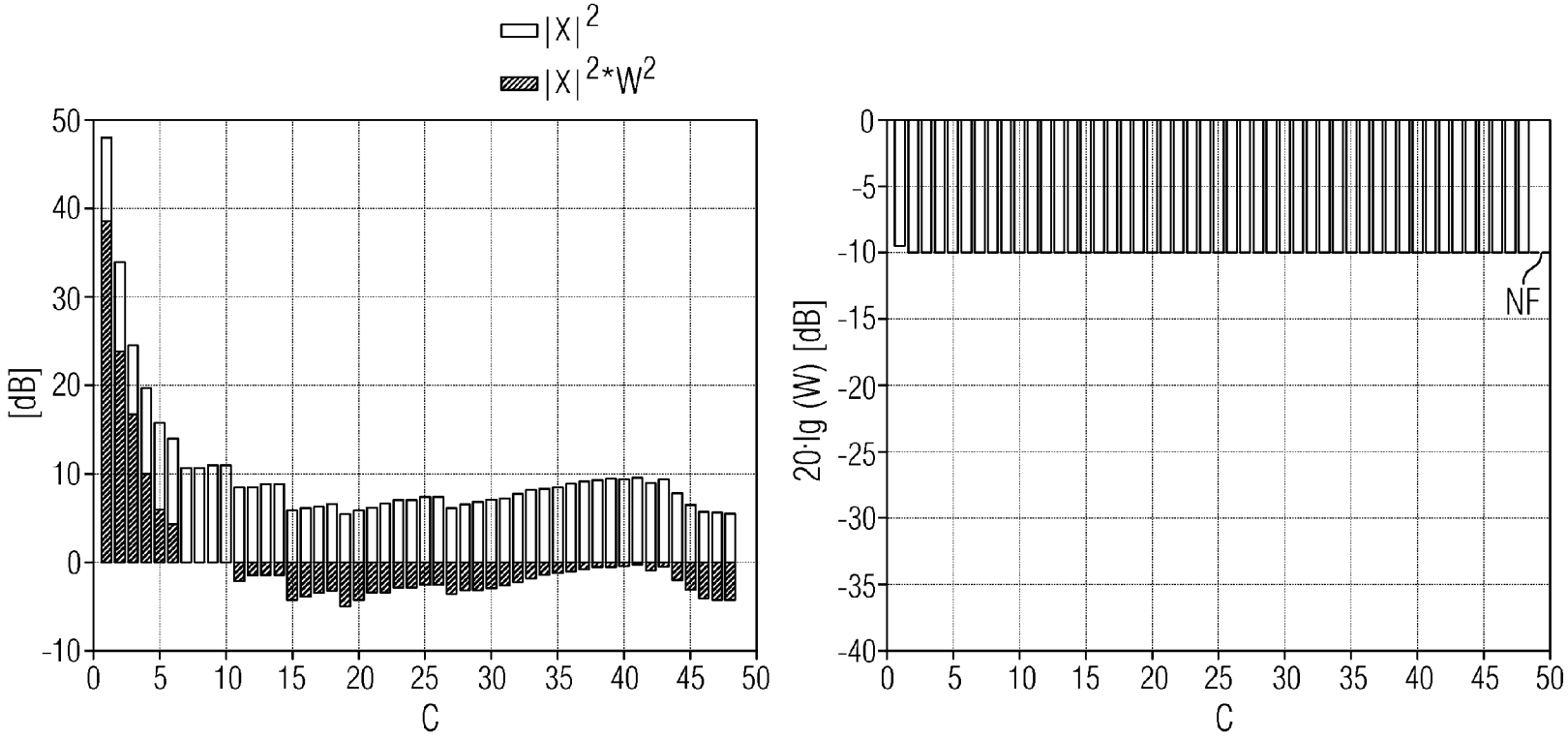
FIG. 8 is a graph showing a setting of maximum attenuation values, as can be provided in the hearing apparatus in FIG. 2 and FIG. 4.
Figure 9:
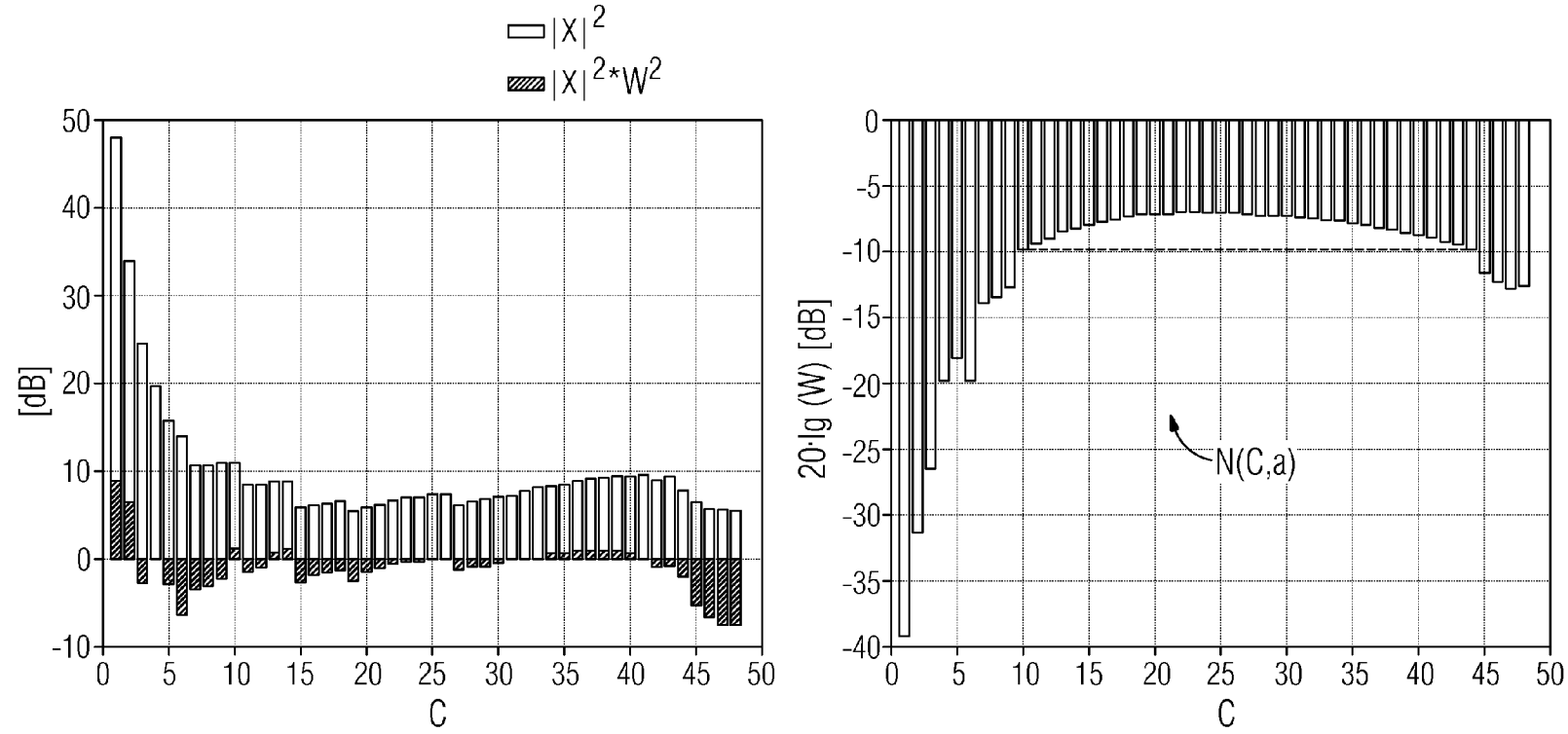
FIG. 9 is a graph showing a further setting of maximum attenuation values, as can be provided in the hearing apparatus according to FIG. 4.

FIGS. 8 and 9 show two alternative options, which further improve the audio quality of the input signal x processed by the multiplier 20 or 60. The diagrams are shown here in the instance that a beam-former, like the beam-former 56, is used. The noise power of the microphone noise, in particular for low frequencies, can be significantly amplified by the beam-former 56 as a function of the value for the directional parameter a in the ratio of the original microphone noise of the microphone 48, 50. FIGS. 8 and 9 to this end show the level of the microphone noise for a specific time instant for several channels C of the filter banks 52, 54 and a specific setting of the parameter a prior to attenuation by the multiplier 60 (as a bar chart $|x|^2$) and after attenuation (as bar chart $|x|^2*W^2$). In order not to amplify a fluctuation in the level of the microphone noise on account of the time-variant attenuation M, the attenuation W is restricted to a maximum attenuation value NF, which amounts here logarithmically in the example shown in FIG. 8 NF=−10 dB. Accordingly, signal parts of the microphone noise in the input signal remain perceivable to a user in the low-frequency range (here in particular the channels 0 to 7) even after attenuation. These nevertheless contain less interfering modulation on account of limiting the attenuation to the maximum attenuation value NF.

A strong attenuation of the microphone noise of this type, which is no longer perceivable to the user him/herself, is produced for the remaining channels (channels C=6-47). The microphone noise also has stationary behavior after the processing, which it has also featured prior to the processing by the beam-former.

In order also to reach the maximum attenuation NF when determining the value, such that the microphone noise is reduced to a comfortable level, the beam-former characteristic, e.g. in the form of the value of the directional parameter a, can also be taken into account. A frequency-dependent maximum attenuation NF (C, a) can be determined by the White Noise Gain WNG. The aim here is to achieve an attenuated microphone noise, in which the channels C have an almost identical level of the microphone noise and this level is independent of a momentary setting of the beam-former, i.e. the value for the directional parameter a.

Such a frequency-dependent setting of the maximum attenuation NF(C,a) is shown in FIG. 9 in the right-hand diagram. The values for the maximum attenuation NF(C,a) are frequency and also time-dependent and represent a function of the value of the directional parameter a. The left diagram shows how a spectrally almost flat course of the microphone noise is achieved by a maximal limitation NF (C, a) of this type. Limiting the attenuation to a maximum attenuation can be implemented within the Wiener filter 26 for instance. It should be noted here that limiting the attenuation means that the Wiener gain W' does not become smaller than a value corresponding to the value NF or NF(C, a). Limiting the attenuation factor W to small values produces a so-called noise floor in the processed input signal.

On the basis of the value for the directional parameter a, the limit value G can also be set for the masking facility 36, if this is provided in the facility 58. This herewith then prevents the Wiener filter from deactivating because a level of the microphone noise results on account of the beam-former 56, which is greater than the level of the microphone noise to be expected on account of the characteristic curve 30.

In summary, it should be noted that with a beam-former with an adjustable directional characteristic, an efficient reduction in the microphone noise is possible to a comfortable level. In addition, the approach is advantageous in that so-called "noise flags" are prevented, which are otherwise typically caused in a signal of a beam-former. Such noise flags may follow a signal of an external sound source, such as for instance a speaker, if this sound source falls silent and the microphone noise is then audible for the user of the hearing apparatus, because it is not attenuated sufficiently quickly. The rapid adjustment is enabled with the approaches inter alia by the limiter 32, which keeps the estimation of the noise power of the microphone noise NPSD to a level which already lies very close to the actual microphone noise.

The invention claimed is:

1. A method for reducing inherent microphone noise generated independently of ambient noise in an input signal of a hearing apparatus, which comprises the steps of:

forming the input signal from a plurality of microphone signals by means of a beam-former, in which a directional effect can be set with an aid of a directional parameter, and when determining a noise power, the input signal is initially scaled in dependence on a current value of the directional parameter;

filtering the input signal via a Wiener filter if the noise power determined for the input signal is smaller than a predetermined limit value for assisting in reducing the inherent microphone noise; and deactivating the Wiener filter if the noise power is greater than the predetermined limit value or equal to the predetermined limit value for assisting in reducing the inherent microphone noise.

2. The method according to claim 1, which further comprises, for noise power-dependent deactivation, weighting an attenuation of the Wiener filter acting on the input signal with a weighting factor, which is a function of the noise power.

3. The method according to claim 2, wherein the function forms a gradual transition between a completely active attenuation and a completely deactivated attenuation.

4. The method according to claim 1, which further comprises limiting the noise power to a predetermined highest value.

5. The method according to claim 1, which further comprises estimating the noise power for at least one signal part of the input signal on a basis of the signal part according to a statistical estimation method.

6. The method according to claim 1, which further comprises determining the noise power for at least one signal part of the input signal on a basis of a characteristic microphone noise curve.

7. The method according to claim 1, which further comprises defining the predetermined limit value on a basis of a characteristic curve of a microphone.

8. The method according to claim 1, which further comprises limiting attenuation of the Wiener filter acting on the input signal to a predetermined maximum attenuation value with an active Wiener filter.

9. The method according to claim 1, which further comprises back-scaling the noise power in dependence on the current value of the directional parameter.

10. The method according to claim 1, which further comprises limiting an attenuation of the Wiener filter acting on the input signal to a highest value in dependence on the current value of the directional parameter.

11. The method according to claim 1, wherein the predetermined limit value is dependent on the current value of the directional parameter.

12. The method according claim 3, which further comprises forming the gradual transition according to a ramp function or a tangens hyperbolicus function.

13. A hearing apparatus, comprising:

a plurality of microphones;

a facility for reducing inherent microphone noise generated independently of ambient noise and receiving signals from said plurality of microphones, said facility for reducing said microphone noise having a Wiener filter and an estimation facility coupled to said Wiener filter for determining an estimated value for a noise power, wherein an input signal can be subjected to an attenuation by means of said Wiener filter for generating a processed input signal and a value of the attenuation can be determined on a basis of the estimated value for the noise power, said facility for reducing said microphone noise is set up to monitor the estimated value for the noise power and to deactivate said Wiener filter, if the estimated value is greater than a predetermined limit value;

a beam-former; and said plurality of microphones sending the signals to said facility for reducing the microphone noise via said beam-former, by means of said beam-former the input signal can be generated from the signals of said plurality of microphones for said facility for reducing the microphone noise and in which a directional effect can herewith be set with an aid of a directional parameter, wherein said facility for reducing the microphone noise is set up to reduce the microphone noise, to determine the estimated value by means of said estimation facility for the noise power, and to scale the input signal in dependence on a value of the directional parameter when determining the noise power.

* * * * *